United States Patent [19]

Agee

[11] Patent Number: 4,963,078

[45] Date of Patent: Oct. 16, 1990

[54] STRESS AND TORQUE REDUCING TOOL AND METHOD

[76] Inventor: John O. Agee, P.O. Box 507, Big Lake, Tex. 76932

[21] Appl. No.: 199,172

[22] Filed: May 26, 1988

[51] Int. Cl.[5] ..... F04B 21/04

[52] U.S. Cl. ..... 417/545; 188/286

[58] Field of Search ..... 417/545, 547, 548, 550, 417/555.1; 188/286, 287; 267/125; 74/583

[56] References Cited

U.S. PATENT DOCUMENTS

| | | | |
|---|---|---|---|
| 1,658,962 | 2/1928 | Aikens | 92/177 |
| 2,153,816 | 4/1939 | Stevens | 267/125 |
| 2,258,493 | 10/1941 | Hull | 417/548 |
| 2,259,021 | 10/1941 | Wineman | 267/125 |
| 2,674,956 | 4/1954 | Hilton | 417/513 |
| 2,693,758 | 11/1954 | Pierce | 417/548 |
| 2,953,352 | 9/1960 | Webb | 267/125 |
| 3,051,237 | 8/1962 | Liles, Jr. et al. | 74/583 |
| 3,292,552 | 12/1966 | Chancellor et al. | 417/571 |
| 3,338,141 | 8/1967 | Ramsay | 92/177 |
| 4,332,533 | 6/1982 | Spears | 417/513 |
| 4,571,162 | 2/1986 | Knox | 417/554 |
| 4,779,852 | 10/1988 | Wassell | 267/125 |

OTHER PUBLICATIONS

*Foreign Engineering News,* Mar. 15, 1957, p. 20.

*Primary Examiner*—Leonard E. Smith
*Assistant Examiner*—Robert N. Blackmon
*Attorney, Agent, or Firm*—Robert C. Peterson

[57] ABSTRACT

A stress and torque reducing tool particularly useful in production of petroleum fluids from oil wells employing a reciprocating pump located within the well bore in the reservoir which is operated by means of sucker rods attached to a surface walking beam pump operating unit. The tool is deployed intermediate the sucker rod string and the plunger rod of the downhole reciprocating pump and provides a means for hydraulically dissipating shock forces encountered in the operation of the subsurface reciprocating pump occurring from fluid pound, gas pound and/or deliberately bottoming the plunger rod to avoid gas lock.

11 Claims, 3 Drawing Sheets

STRESS AND TORQUE REDUCING TOOL AND METHOD

BACKGROUND OF INVENTION

1. Technical Field

This invention relates to means for reducing stress and torque associated with pumping operations for the production of oil from a non-flowing oil well. In particular, the invention relates to a stress and torque reducing tool (hereinafter frequently referred to as "STR TOOL") employed to reduce damage to subsurface equipment.

In the production of petroleum fluids from oil wells which do not flow, it is a common practice to employ a reciprocating pump which is located deep within the well bore and which is operated by means of a string of sucker rods extending to the ground surface. The upper or polished rod section of the sucker rod string is ordinarily reciprocated by a pump operating unit consisting of a walking beam, one end of which is connected by a horsehead sling to the polished rod and the other end is connected by a Pittman to a rotating crank which is driven by a suitable prime mover, such as an electric motor.

In the operation of reciprocating pumps through the use of sucker rods for the production of oil and associated gas, the sudden reversal movement at the end of the upstroke and the downstroke of the sucker rods imposes reversal strains on the sucker rods as the stretch of the sucker rods is either suddenly released or suddenly imposed upon the rods.

In addition, the subsurface pumps used in connection with the sucker rods can undergo what is referred to as gas lock. This is a condition which occurs when gas enters the area below the plunger of a conventional pump, when the plunger is at the uppermost position of its normal travel and while traveling through its lowermost point of travel, cannot compress the gas to a pressure sufficient to force the traveling valve open. On the following upstroke, the gas expands keeping the pressure high enough in the area below the plunger that the standing valve will not open and allow fluid to enter the pump. This compressing and expanding of gas repeats itself on each downstroke and each upstroke without increasing pressure enough to open the traveling valve, or decreasing in pressure enough to allow the standing valve to open and allow fluid to enter the pump.

Another condition referred to as "fluid pound" occurs when the plunger of the conventional pump is at its uppermost point of travel, and not enough fluid enters the pump to completely fill the area vacated by the plunger, and the plunger while moving on its downstroke impacts the fluid which is substantially incompressable, thus severely jarring the sucker rods and pump. Such condition could occur on every downstroke of the pump and sucker rods. A similar occurrence called a "gas pound" occurs when the plunger on the downstroke compresses gas to a pressure greater than the rod weight but not sufficient pressure to open the traveling valve.

2. Background Information

Conventional pumping devices in oil wells frequently develop gas locks. The solution to this problem in the past has been to space the pumps where it actually bumps bottom on every stroke to eliminate gas locks. This action of bumping bottom causes many destructive effects. It increases the stress range on sucker rods. It causes the rods to go into the compression state each and every time the pump bumps the bottom. It also causes the rods to buckle and slap the inside of the tubing, which causes increased wear to the rods, rod couplings and tubing. When the pump bumps bottom and causes the entire weight of the rods to be transferred to the tubing string in a shock load, which can cause premature failure of tubing couplings and threads, such shock loads are also transferred to the pumping unit when the pump bumps bottom resulting in premature failure of structural bearings and torque reversals in the gears of the gear box causing excessive wear on the gear teeth and gear box bearing. Unintentional gas or fluid pounding in operation of conventional pumps is a common problem in low fluid level wells and marginal producing wells. In order to reduce strain on the sucker rods and the pump, one approach outlined by Hilton (U.S. Pat. No. 2,674,956) is to provide one or more stagers or valve assemblies mounted intermediate the sucker rod string which close on the upstroke and open on the downstroke so that the static head on the traveling valve in the pump will be reduced by transferring a portion of such head to the stagers. In addition, Hilton provides an arrangement to retard the downward movement of the sucker rods by forming buffers which restrict the flow of liquid through the corresponding stager valves and afford somewhat of a buoyant effect for the sucker rods. Other techniques for handling gas locks have been developed such as those proposed by Spears Specialty Oil Tool of Tomball, Tex. who according to their literature have developed a tool referred to as a "Buster" that uses hydrostatic head in the tubing to load or cock itself on the upstroke and as the sucker rod reverses to start the downstroke, the Buster releases and bumps the top of the plunger. This action unseats the traveling balls allowing compressed gas to be transferred out of the pump into the tubing in a controlled fashion. The same company has devised a valving system which unseats the traveling valve. This company refers to the tool as a "Sidekicker" and advertised as a pending application. Spears (U.S. Pat. No. 4,332,533) describes a fluid pump which is intended to be more efficient and thus overcome some of the problems associated with gas pound, gas lock and so forth. Chancellor (U.S. Pat. No. 3,292,552) mentions the problem of gas locking in pumps used in producing high viscosity oil from wells.

OBJECTS AND SUMMARY

This invention provides a new and improved tool for reducing stress and torque in the operation of downhole fluid pumps operated by sucker rods extending from the surface to the pump. Such a reciprocating pump frequently referred to as a sucker rod pump is operated by reciprocating sucker rods by use of a walking beam. The tool of this invention is placed intermediate the sucker rods and the pump traveling valve which reciprocates within the working barrel. The STR Tool provides a fluid cushion between the sucker rods and the traveling valve of the pump, which permits jarring of the pump to unseat the valve and permit gas to escape to avoid gas lock while at the same time dissipating the jarring force in the STR Tool rather than transferring such to the sucker rods.

It is therefor an object of the invention to provide a stress and torque reducing tool intermediate the sucker rods and subsurface pump for dissipating forces associated with fluid or gas pound and intentional bumping bottom or jarring the pump.

It is another object of this invention to provide an apparatus to be used in conventional pumping systems that will allow the pump to bump bottom without increasing the normal stress range on the sucker rods.

It is another object of the invention to provide an apparatus that will allow a conventional pump to bump bottom without placing the sucker rods in compression.

It is another object of the invention to provide an apparatus that will allow a conventional pump to bump bottom without creating torque reversal in the gear box of the pumping unit.

It is another object of the invention to provide an apparatus that will allow a conventional pump to bump bottom without creating shock loads that are transferred to the bearings of the pumping unit structure.

It is another object of the invention to provide an apparatus that will dissipate the impact forces of a fluid or gas pound incurred on low fluid level wells or marginal producing wells.

It is another object of the invention to provide an apparatus that can be installed without any design changes or modifications to either the subsurface pump or the sucker rods and it can be installed and operated with any design or size of subsurface pump without changing the apparatus itself.

It is another object of the invention to provide a stress and torque reducing tool which hydraulically dissipates the shock loads encountered by a conventional downhole reciprocating pump.

DESCRIPTION OF THE INVENTION

Figure 1:
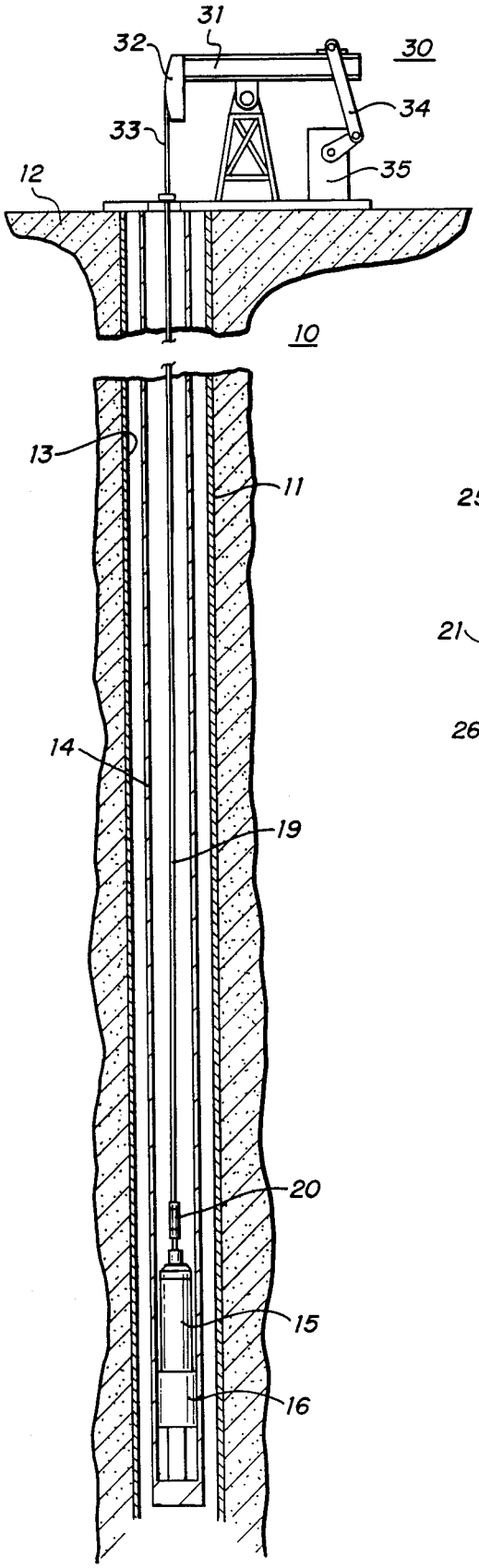
FIG. 1 is a side elevation of a pumping apparatus embodying the principles of the present invention shown disposed within a well casing and driven through a sucker rod string by a reciprocater at the surface of the well.

A typical oil well installation is shown in FIG. 1 generally referred to as ten (10) which illustrates a subterranean hole 11, drilled in the Earth 12, which is lined with a casing 13, which is generally cemented in place. The installation includes a tubing string 14, suspended in the casing 13, by appropriate means. The casing 13 is perforated in the appropriate location to admit oil from the formation in the casing 13. A subsurface pump 15 is installed in the tubing string 14 or the production string and is seated by nipple 16 which seals the production string 14 above the seating nipple from the tubing 14 below the seating nipple.

The subsurface pump 15 is a reciprocating pump operated by typical sucker rod installation and is commonly referred to as a sucker rod pump. The stress and torque reducing tool of the present invention generally referred to as 20, is installed intermediate the subsurface pump 15 and the sucker rod string 19 as will be more fully described later. The sucker rod string 19 extends to the ground surface. The upper or polish rod section of the sucker rod string 19 is ordinarily reciprocated by a pump operating unit generally indicated at 30, consisting of a walking beam 31, one end of which is connected by a horsehead sling 32 to the polished rod 33, and the other end of which is connected by a Pittman to a rotating crank 34 which is driven by a suitable prime mover such as an electric motor 35.

Figure 2:
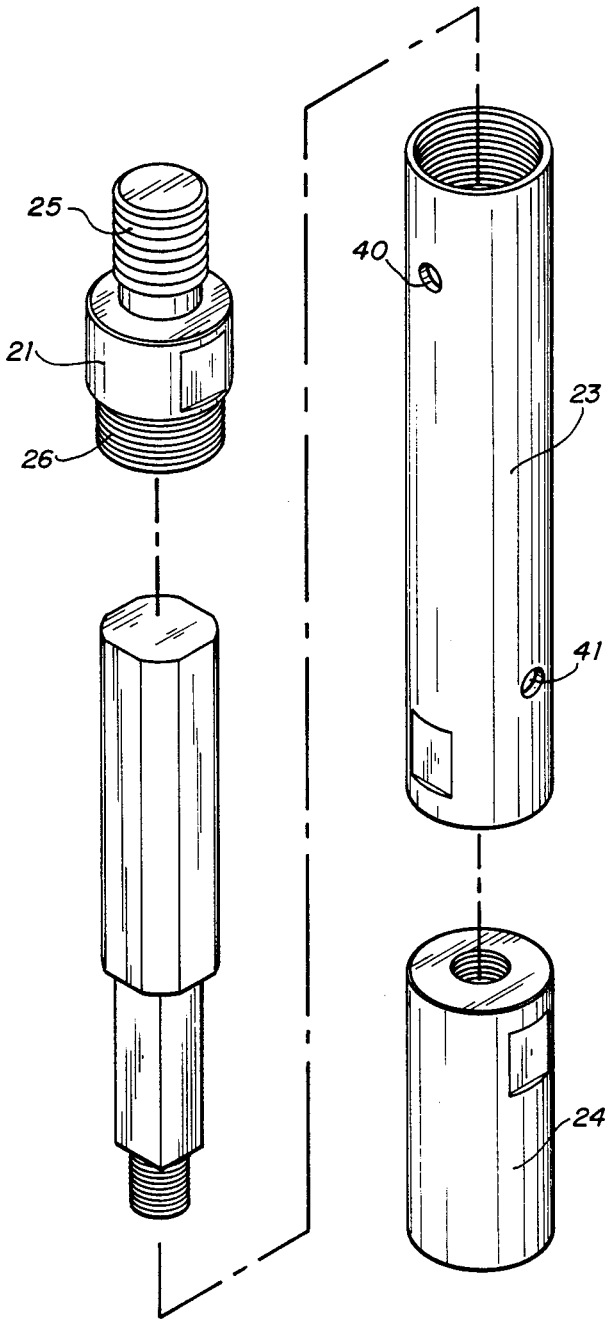
FIG. 2 is an exploded perspective view of the STR Tool illustrating the various components of the tool.
Figure 3:
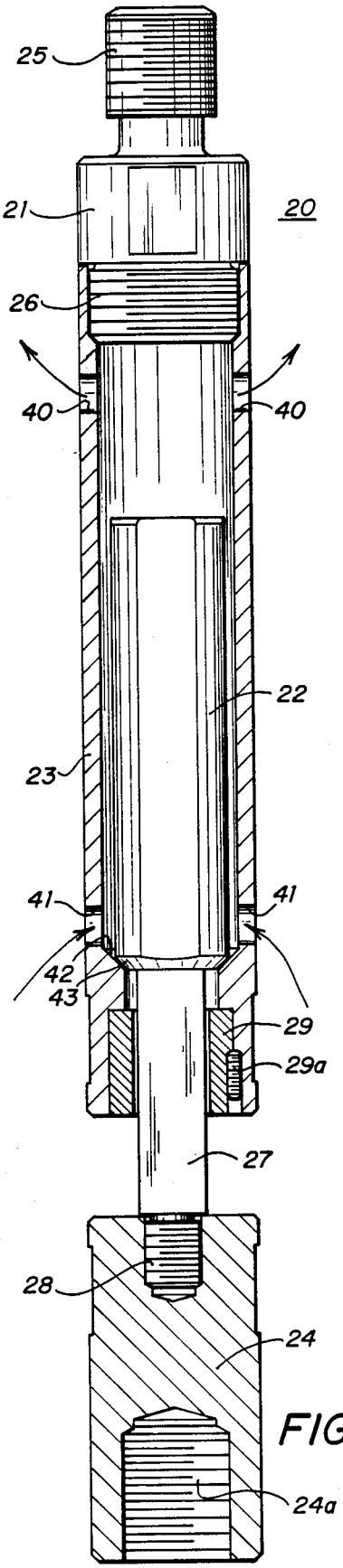
FIG. 3 is a part sectional, part cut-away view of the STR Tool illustrating the relative position after the sucker rod has reached the upper limit and started the downstroke.

Referring to FIGS. 2 and 3, the stress and torque reducing tool 20 comprises a top connector 21, a plunger 22, a body 23 and a bottom connector 24. Top connector 21 has a male thread 25 for threadable engagement with lowermost end of the sucker rod string 19 and a male thread 26 as lowermost portion for threadable engagement with body 23. The plunger includes a shank portion 27 which may be in any shape or form preferable other than round and is illustrated as square which thereby prevents the plunger from rotating and facilitating manual back-off of the sucker rods whenever necessary. The lower portion of the plunger has a male machine thread 28 for threadable engagement with bottom connector 24. The lower end of body 23 has a bushing 29 which conforms to the geometrical shape of shank 27. The bushing 29 is force fitted into body 23 and is further retained in place by an allen head screw **29*a*. The bottom connector 24 has a female thread 24*a* for threadable engagement with the plunger shaft of the subsurface pump 15. The body 23 has upper ports 40 and lower ports 41. The body also has a Chamfered seat 42 which accomodates the Chamfered bottom 43 of plunger 22** when the plunger is fully distended.

The stress reducing tool or STR Tool 20 is placed in operation in the following manner. A typical subsurface pump 15 is placed in the tubing string 14 near the surface and the completely assembled STR Tool 20 is secured by screwing the bottom connector 24 of the STR Tool 20 onto the plunger shaft of the subsurface pump 15. A sucker rod 19 is threadably engaged with the top connector 21 of STR Tool 20 and then the subsurface pump 15 with the STR Tool 20 positioned intermediate the sucker rod 19 and the pump 15 is lowered into the tubing 14 and additional sucker rods 19 are attached until the subsurface pump has been positioned at the appropriate depth in the tubing. Then the hold down device of the subsurface pump is activated and the rod string is connected to the pumping unit at the surface by conventional means and the well is placed in operation.

Figure 4:
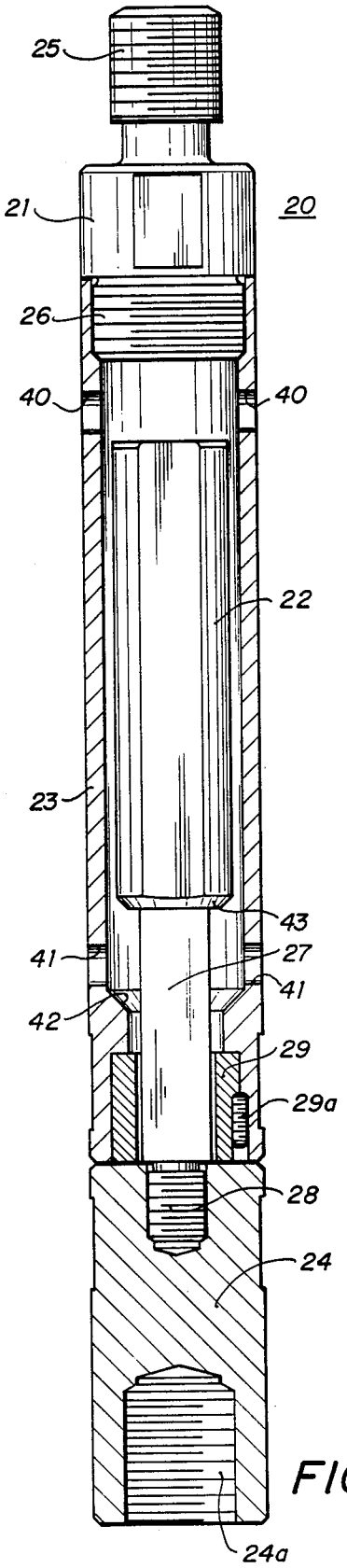
FIG. 4 is a part sectional, part cut-away view of the STR Tool illustrating the position of the body and bottom connector impacted after the sucker rod has started downward and upward momentum of the subsurface pump plunger has subsided.
Figure 5:
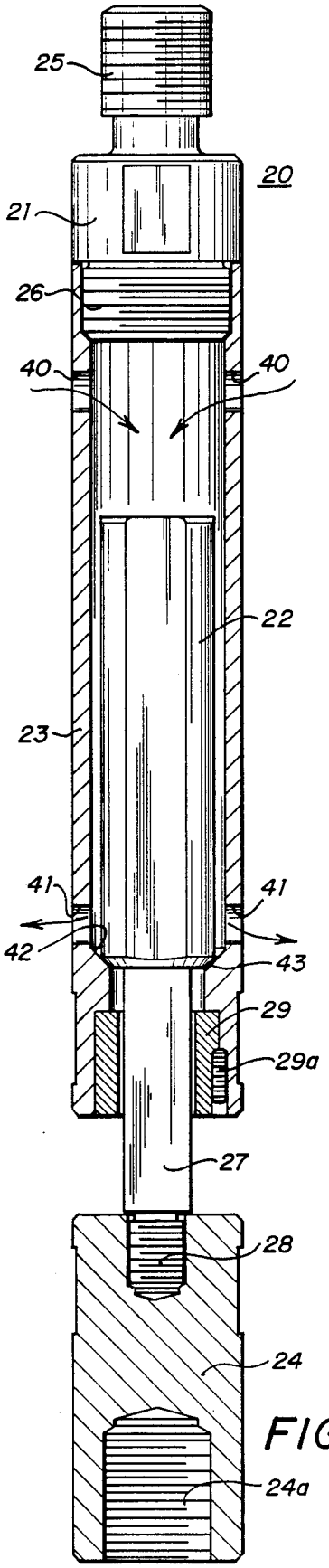
FIG. 5 is a part sectional, part cut-away view illustrating the relative extended position between the body and the bottom connector during the downward travel and just prior to reaching its furthermost downward travel.
Figure 6:
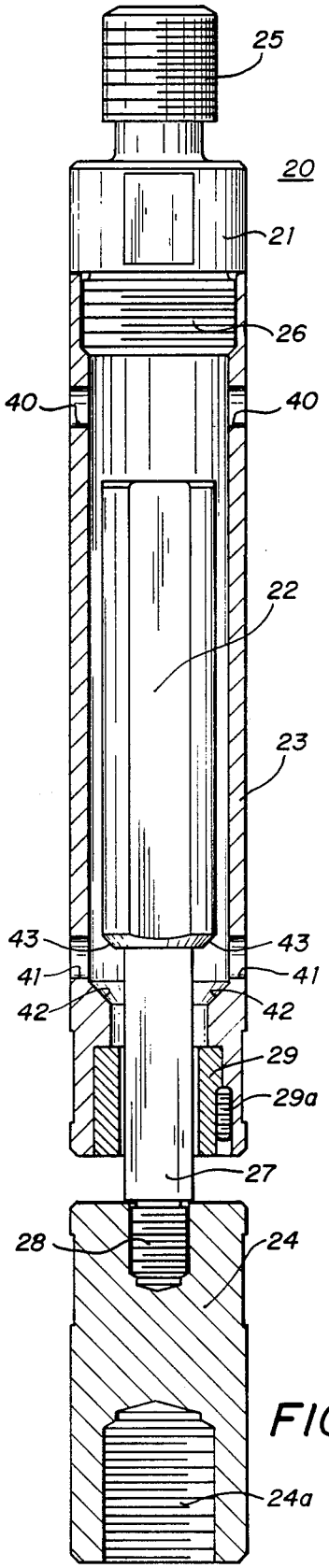
FIG. 6 is a part sectional, part cut-away view of the STR Tool illustrating the relative position of the body and the bottom connector when the sucker rods have reached the lowest point of the downstroke and the jarring forces from bumping bottom or otherwise have been dissipated without placing the sucker rods under a compression load.

When the rod string 19 starts reciprocating, the STR Tool starts to operate. The operation of the STR Tool 20 will be described. FIG. 3, shows the Tool after the sucker rods have reached the upper limit and started the downstroke. At this point, the sucker rod string 19 has changed direction and has headed downward while bottom connector 24 attached to the plunger shaft of subsurface pump 15 continues upward momentum and forces fluid out of the upper fluid ports 40 and admitting fluid through the lower ports 41. FIG. 4 shows further downward travel when the momentum of the bottom connector 24 and the plunger of subsurface pump 15 has subsided, the body 23 of STR Tool 20 impacts the upper surface of bottom connector 24. It will be noticed that the Chamfered bottom 43 has moved off the Chamfered seat 42. Thereafter, the fluid load held by the sucker rods is sufficient to cause the bottom connector 24 to distend as viewed in FIG. 5 and the Chamfered bottom 43 of plunger 22 engages Chamfered seat 42 and continues on the downward stroke of the sucker rods 19 and the fluid is forced into the body 23 intermediate the top connector 21 and the plunger 22. As the plunger of the subsurface pump 15 and the bottom connector 24 have fully descended to the bottom, the body of the STR Tool 20 and the top connector 21 together with the sucker rod string 19 continue downward movement, however, the fluid intermediate the top connector and plunger is forced out of upper ports 40 and into lower ports 41, cushioning the descent of the sucker rod and body of the STR Tool 20 while the plunger 22 together with the bottom connector 24 and the plunger of the subsurface pump have encountered shock forces and are relatively stationary. At this point as viewed in FIG. 6, the sucker rods decelerate and begin to reverse to the upward direction before the lower body of the STR Tool 20 can engage the upper surface of bottom connector 24. Thus, the shock force of the subsurface pump 15 plunger, the bottom connector and the plunger 22 of the STR Tool 20 are cushioned by the fluid being expelled from upper ports 40 and the sucker rods 19 and body 23 of the STR Tool 20 never impact the upper surface of bottom connector 24. The action of the STR Tool 20 effectively isolates the sucker rod string, the walking beam and operating unit from the shock forces of fluid pound or gas pound or intentionally bumping bottom.

For a typical oil well installation utilizing a subsurface pump having a 1½" pump bore to depths of about 7,000 feet or utilizing a subsurface pump having a 2" diameter pump bore to depths of about 5,000 feet, the STR Tool would utilize two upper ports and two lower ports having a 0.375" diameter. The bottom ports would be located no more than 0.250" above the Chamfered seat. The plunger travel would be about 1.500" and the plunger would have a 1.250" diameter. The length of the chamber above the plunger with the plunger fully distended would be about 1.625". The cushioning effect may be varied by changing the diameter of the ports. To increase the cushioning effect, the diameter of the ports is decreased and to decrease the cushioning effect, the diameter of the ports would be increased. Such changes could also be achieved by changing the diameter and/or the length of the plunger.

It will be appreciated that various modifications and changes to the STR Tool heretofore described will be suggested and any such modifications and changes are intended to be covered by this application.

What is claimed is:

1. Apparatus for coupling a sucker rod string to a subsurface reciprocating pump in a well bore for production of fluid comprising;

a hollow body means having fluid ports in the upper and lower portions thereof;

an aperture means within the lower portion of said hollow body means;

a plunger means positioned within said hollow body means having a shank extending through said aperture means, said plunger means adapted for limited reciprocating relative movement within said hollow body means;

means for attaching the upper portion of said hollow body means to the bottom of the sucker rod string and means for attaching the plunger means to the subsurface reciprocating pump such that the stress forces encountered in the operation of the subsurface reciprocating pump are dissipated by the apparatus through said limited reciprocating relative movement of the plunger means within said hollow body means;

means for limiting relative rotational movement between the plunger means and the hollow body means.

2. The apparatus of claim 1 wherein said means for limiting relative rotational movement includes said aperture means with a square hole and said shank with a square cross section.

3. The apparatus of claim 1 wherein said means for limiting relative rotational movement include said aperture means with a hexagonal hole and said shank with a hexagonal cross section.

4. Apparatus for coupling a sucker rod string to a subsurface reciprocating pump in a well bore for production of fluid comprising:

a hollow body means having upper and lower fluid ports;

a noncircular aperture within the lower portion of said body;

a top connector means for attaching the upper portion of said hollow body means to the bottom of the sucker rod string;

a bottom connector means for attachment to the plunger of the reciprocating subsurface pump;

a plunger means having a head and a noncircular shank matching said noncircular aperture, said plunger means positioned within said body with the shank extending through said aperture and attached to said bottom connector means, said plunger adapted for limited reciprocating movement within said body to isolate the shock forces encountered in the operation of the subsurface reciprocating pump from the sucker rods and pump operating unit, yet allowing impact between the bottom connector means and the hollow body.

5. The apparatus of claim 4 wherein said hollow body is a tubular body.

6. The apparatus of claim 4 wherein said noncircular aperture is square and said shank is square.

7. The apparatus of claim 4 wherein said noncircular aperture is hexagonal and said shank is hexagonal.

8. In a well pumping apparatus, for a well having a fluid therein, including an elongated string of tubing extending into such fluid in the well, a subsurface reciprocating pump disposed in said tubing string within the fluid reservoir, a sucker rod string disposed in said tubing, and an operating unit for reciprocating the sucker rods, the improvement comprising;

apparatus for attachment intermediate the bottom of the sucker rods and the plunger shaft of the subsurface pump, said apparatus comprising;

a hollow body means having upper and lower fluid ports;

a top connector means secured to the upper end of said body for attachment to the bottom of the sucker rods;

a bottom connector means for attachment to the plunger shaft of the subsurface pump;

a noncircular shaped aperture means within the lower end of said body;

a plunger means having a head and a noncircular shaped shank portion matching said noncircular shaped aperture means, said plunger means positioned within said body with said noncircular shaped portion extending through said aperture means and attached to said bottom connector means, said plunger means adapted for limited reciprocating movement within and relative to said body and throttling fluid which isolate the sucker rods and pump operating unit from stress forces encountered in the operation of the subsurface pump while permitting impact between said bottom connector means and hollow body means to accelerate downward travel of the sucker rods and plunger of the subsurface pump.

9. The apparatus of claim 8 wherein said hollow body is a tubular body.

10. The apparatus of claim 8 wherein said noncircular aperture is square and said shank is square.

11. The apparatus of claim 8 wherein said noncircular aperture is hexagonal and said shank is hexagonal.

* * * * *